US012312953B2

(12) United States Patent
Trushin et al.

(10) Patent No.: US 12,312,953 B2
(45) Date of Patent: May 27, 2025

(54) STEERING ACTUATION METHODOLOGY FOR A ROTARY STEERABLE SYSTEM

(71) Applicant: Schlumberger Technology Corporation, Sugar Land, TX (US)

(72) Inventors: Alexander Trushin, Cheltenham (GB); Ling Li, Stonehouse (GB); Geoffrey Charles Downton, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 185 days.

(21) Appl. No.: 18/048,056

(22) Filed: Oct. 20, 2022

(65) Prior Publication Data

US 2023/0131473 A1 Apr. 27, 2023

Related U.S. Application Data

(60) Provisional application No. 63/262,811, filed on Oct. 21, 2021.

(51) Int. Cl.

| | |
|---|---|
| ***E21B 7/06*** | (2006.01) |
| ***E21B 21/08*** | (2006.01) |
| ***E21B 47/00*** | (2012.01) |
| ***E21B 47/12*** | (2012.01) |

(52) U.S. Cl.

CPC ..... *E21B 7/06* (2013.01); *E21B 21/08* (2013.01); *E21B 47/00* (2013.01); *E21B 47/12* (2013.01)

(58) Field of Classification Search

CPC . E21B 7/06; E21B 21/08; E21B 47/00; E21B 47/12; E21B 17/1014; E21B 44/02; E21B 7/064

See application file for complete search history.

(56) References Cited

U.S. PATENT DOCUMENTS

| | | | | |
|---|---|---|---|---|
| 8,200,436 | B2 | 6/2012 | Sato et al. | |
| 8,672,056 | B2 | 3/2014 | Clark et al. | |
| 8,919,459 | B2 | 12/2014 | Polyntsev | |
| 9,309,722 | B2 | 4/2016 | Kibsgaard et al. | |
| 9,394,745 | B2 | 7/2016 | Bayliss et al. | |
| 9,435,649 | B2 | 9/2016 | Sato et al. | |
| 10,439,474 | B2 | 10/2019 | Hall et al. | |
| 10,605,005 | B2 | 3/2020 | Downton | |
| 11,118,408 | B2 | 9/2021 | Marshall et al. | |
| 2006/0263215 | A1* | 11/2006 | Sindt | E21B 4/02 416/9 |
| 2009/0050370 | A1* | 2/2009 | Peters | E21B 7/06 175/45 |
| 2020/0199942 | A1 | 6/2020 | Downton | |
| 2022/0003043 | A1* | 1/2022 | Nanayakkara | E21B 7/10 |
| 2023/0130310 | A1 | 4/2023 | Ignova | |

* cited by examiner

*Primary Examiner* — Yanick A Akaragwe

(74) *Attorney, Agent, or Firm* — Jeffrey D. Frantz

(57) ABSTRACT

A method for drilling a subterranean wellbore includes rotating a bottom hole assembly (BHA) in the wellbore to drill. The BHA includes a rotary steerable tool or a steerable drill bit having at least one external pad configured to extend radially outward into contact with a wall of the wellbore and thereby steer the drilling. A rotation rate of the BHA is measured and a drilling parameter waveform is received. The rotation rate and the waveform are processed to select discrete times for extending the at least one external pad while drilling.

15 Claims, 6 Drawing Sheets

STEERING ACTUATION METHODOLOGY FOR A ROTARY STEERABLE SYSTEM

CROSS REFERENCE TO RELATED APPLICATIONS

This application claims the benefit of, and priority to, U.S. patent application Ser. No. 63/262,811, filed Oct. 21, 2021, which application is expressly incorporated herein by this reference in its entirety.

BACKGROUND

The use of rotary steerable systems is well known in downhole drilling operations. Rotary steerable systems are known, for example, to improve rate of penetration of drilling, provide improved hole cleaning owing to the continuous rotation of the drill string, and to provide more accurate well placement at a reduced overall cost as compared to mud motor/bent sub technology.

Numerous commercially available rotary steerable systems make use of hydraulically actuated pads (or blades) to steer. In such systems, the pads may be extended outward from the tool body or retracted inward towards the tool body to actuate and/or adjust the direction of drilling. While such rotary steerable systems are suitable in a wide range of drilling operations, there is room for further improvement. For example, there is a need to improve control of extension and retraction of the hydraulically actuated pads to provide improved wellbore position control, more efficient steering, and better hole quality.

SUMMARY

A method for drilling a subterranean wellbore is disclosed. The method includes rotating a bottom hole assembly (BHA) in the wellbore to drill. The BHA includes a rotary steerable tool or a steerable drill bit having at least one external pad configured to extend radially outward into contact with a wall of the wellbore and thereby steer the drilling. A rotation rate of the BHA is measured and a drilling parameter waveform is received. The rotation rate and the waveform are processed to select discrete times for extending the at least one external pad while drilling.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which:

FIG. 3-1 depicts another example lower BHA portion on which disclosed embodiments may be utilized.

FIG. 3-2 depicts an example steerable drill bit on which disclosed embodiments may be utilized.

FIGS. 4-1 and 4-2 (collectively FIG. 4) depict cross sectional views of one of the pads shown on FIGS. 2, 3-1, and 3-2 in extended (FIG. 4-1) and retracted (FIG. 4-2) positions.

DETAILED DESCRIPTION

Disclosed embodiments relate generally to downhole drilling methods and more particularly to methods for actuating steering elements in a rotary steerable system. For instance, methods for drilling a subterranean wellbore are disclosed. In some embodiments, the methods include rotating a BHA in the wellbore to drill, measuring a rotation rate of the BHA, and receiving a drilling parameter waveform. The rotation rate and the waveform are processed to select discrete times for extending and/or retracting the at least one external pad while drilling.

The disclosed embodiments may provide various technical advantages and improvements over the prior art. For example, some embodiments may provide for improved steering efficiency and reduced pad wear during drilling. The disclosed embodiments may further provide for a smoother hole profile and therefore improve overall hole quality.

Figure 1:
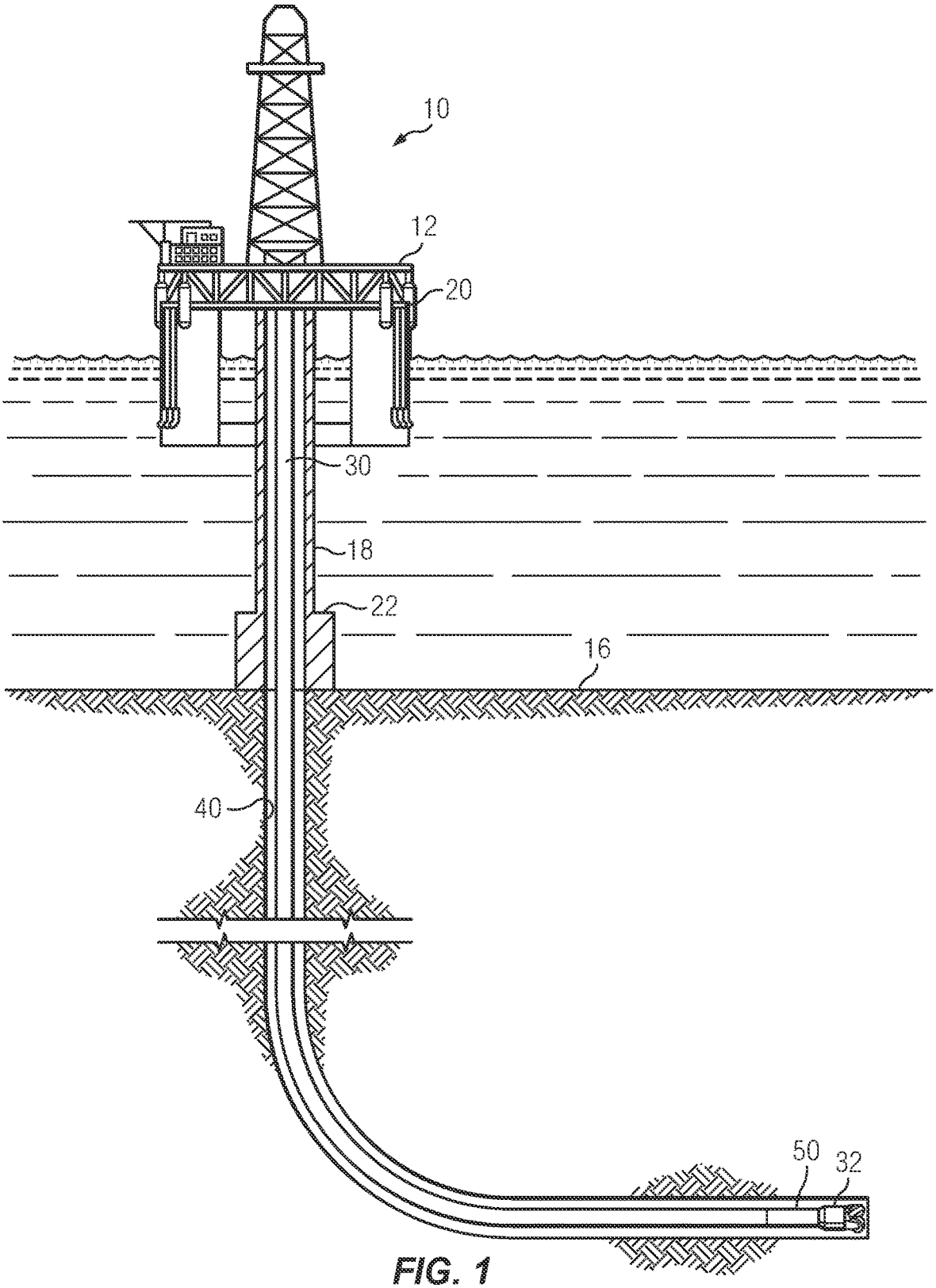
FIG. 1 depicts an example drilling rig on which disclosed embodiments may be utilized.

FIG. 1 depicts a drilling rig 10 suitable for implementing various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a rotary steerable tool 50. Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible drilling platform 12 as illustrated on FIG. 1. The disclosed embodiments are equally well suited for use with any kind of subterranean drilling operation, either offshore or onshore.

With continued reference to FIG. 1, rotary steerable tool 50 may include substantially any suitable rotary steerable tool that makes use of independently actuatable external steering pads. External steering pads are known, for example, in PowerDrive® rotary steerable systems (available from Schlumberger). The PowerDrive® X5, X6, and Orbit rotary steerable systems make use of drilling fluid (mud) actuated pads that contact the wellbore wall. The extension of the pads is rapidly and/or continually adjusted as the system rotates in the wellbore. To drill a desired curvature, a bias phase and neutral phase may be alternated during drilling at a predetermined ratio (referred to as the steering ratio as described in more detail below).

Figure 2:
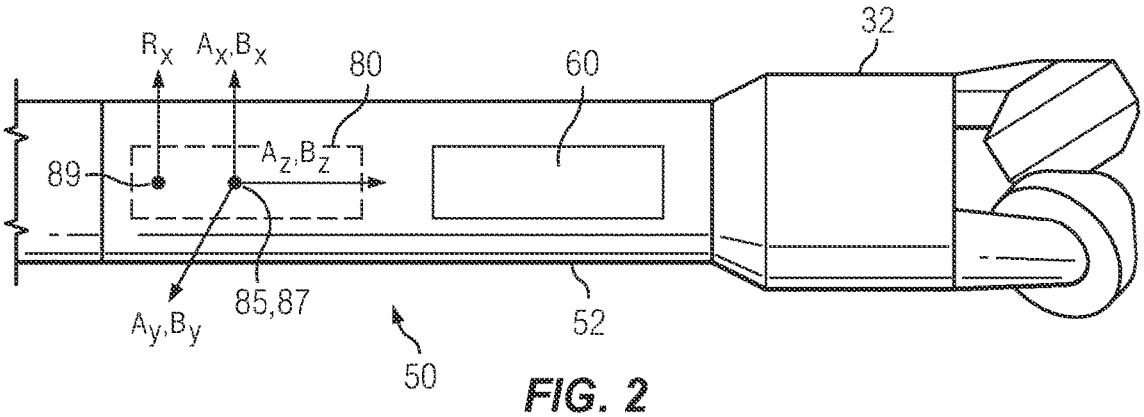
FIG. 2 depicts an example lower BHA portion of the drill string shown on FIG. 1 on which disclosed embodiments may be utilized.

FIG. 2 depicts the lower BHA portion of drill string 30 including drill bit 32 and a suitable rotary steerable tool 50. In the depicted embodiment, rotary steerable tool 50 includes one or more pads 60 deployed in and configured to be extended outward from and retracted inward towards a rotating tool collar 52. A common tool embodiment includes three circumferentially spaced pads deployed at approximately 120 degree intervals about the collar. As described above, the pads may be independently extended outward into contact with the wellbore wall so as to push or point the drill bit 32 in a desired direction (toolface angle) and thereby actuate steering.

While the disclosed embodiments are not limited in this regard, rotary steerable tool 50 may further include navigation (survey) sensors 85, 87, and 89 deployed in a sensor housing 80 (such as a roll-stabilized housing). These sensors 85, 87, and 89 may include, for example, tri-axial accelerometer 85 and tri-axial magnetometer 87 sensor sets and an inertial (gyroscopic) sensor 89. The navigation sensors may include substantially any suitable commercially available devices, for example, including conventional Q-flex type accelerometers or micro-electro-mechanical systems (MEMS) solid-state accelerometers, ring core flux gate magnetometers or magnetoresistive sensors, and MEMS type gyros.

FIG. 2 further depicts a diagrammatic representation of the navigation sensors 85, 87, and 89. By tri-axial it is meant that accelerometer and magnetometer sensor sets each include three mutually perpendicular sensors, the accelerometers being designated as $A_x$, $A_y$, and $A_z$ and the magnetometers being designated as $B_x$, $B_y$, and $B_x$. By convention, a right handed system is designated in which the z-axis accelerometer and magnetometer ($A_z$ and $B_z$) are oriented substantially parallel with the tool axis (and therefore the wellbore axis) as indicated (although disclosed embodiments are not limited by such conventions). In the depicted embodiment gyro 89 is aligned with the x-axis and is designated as $R_x$. Of course, the disclosed embodiments are not limited to those including only a single gyroscopic sensor. Any suitable number of gyroscopic sensors may be employed, for example, including one, two, three, or more (e.g., including a triaxial gyroscopic sensor set). Moreover, the gyroscopic sensor(s) may be deployed on a drive mechanism that rotates the sensor so that it can be aligned with the x- or y-axis of a conventional right handed xyz coordinate system. Suitable gyroscopic sensor embodiments are disclosed in commonly assigned U.S. Pat. Nos. 8,200,436 and 9,435,649.

Figures 1, 3:
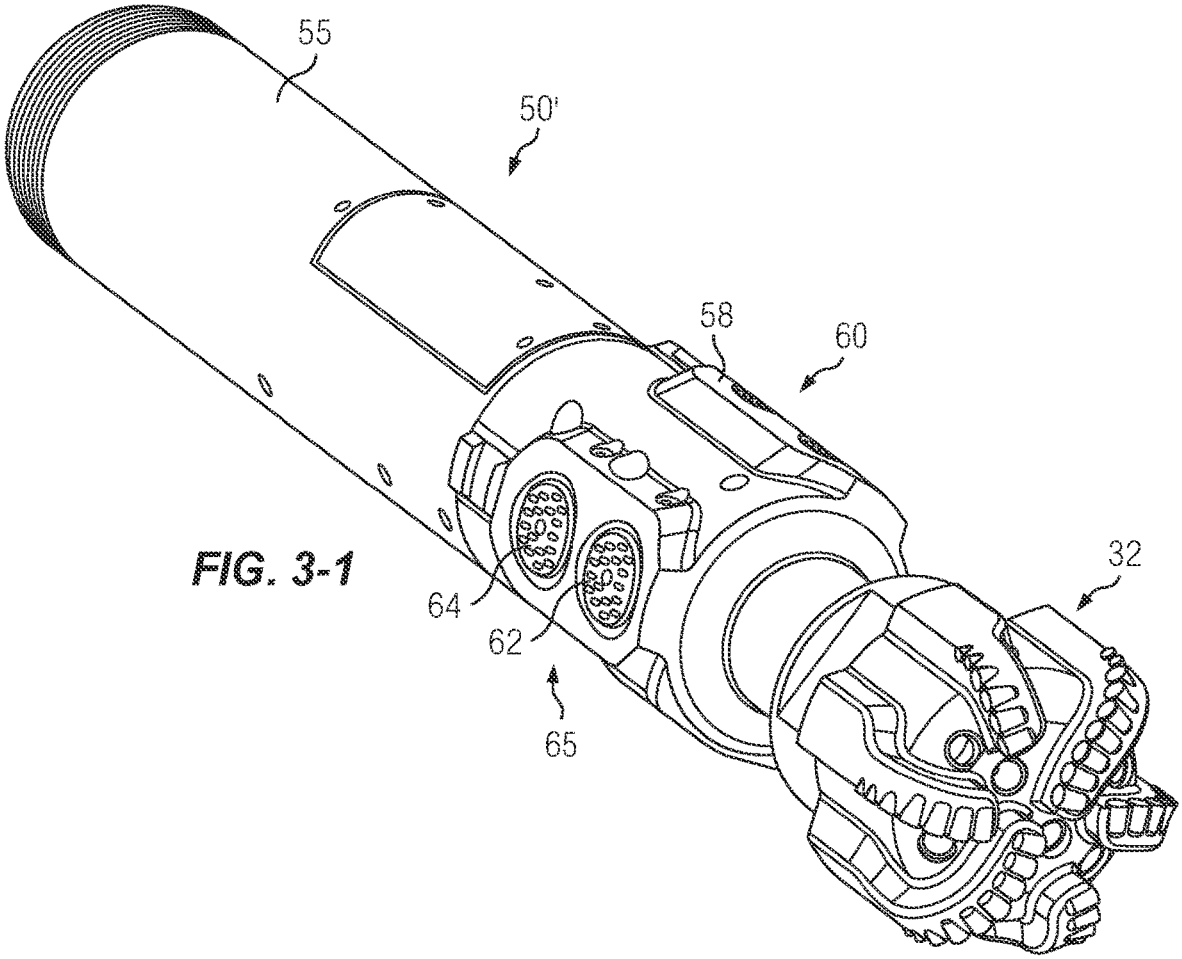
Figures 2, 3:
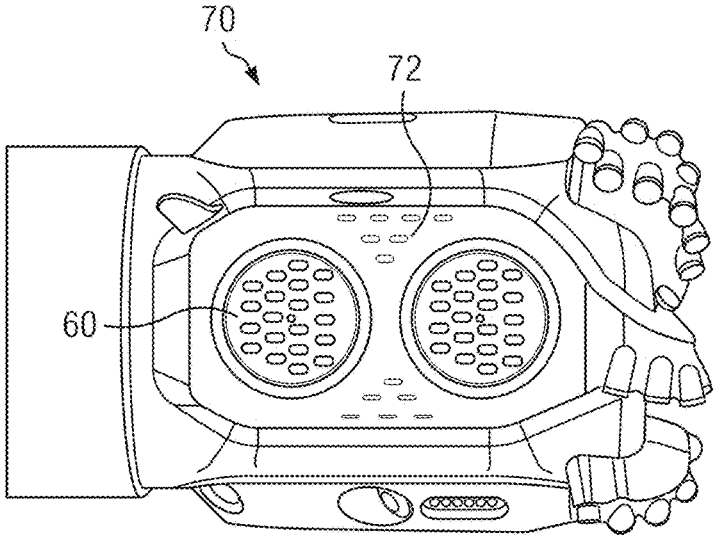

FIG. 3-1 depicts an alternative rotary steerable tool embodiment 50' that includes three circumferentially spaced pad pairs 65 (e.g., spaced at approximately 120 degree intervals about the tool circumference). Each pad pair 65 includes first and second axially spaced pads 62 and 64 deployed in/on a gauge surface 58 of collar 52 configured to rotate with the drill string. Each of the pads 60 is configured to extend outward from the collar 52 into contact with the wellbore wall and thereby actuate steering.

Turning now to FIG. 3-2, it will be understood that the disclosed embodiments are not limited to rotary drilling embodiments in which the drill bit and rotary steerable tool are distinct separable tools (or tool components). FIG. 3-2 depicts a steerable drill bit 70 including a plurality of steering pads 60 deployed in the sidewall of the bit body 72 (e.g., in/on wellbore gauge surfaces). Steerable bit 70 may be thought of as an integral drilling system in which the rotary steerable tool and the drill bit are integrated into a single tool (drill bit) body 72. Drill bit 70 may include substantially any suitable number of pads 60, for example, three pairs of circumferentially spaced pad pairs in which each pad pair includes first and second axially spaced pads as described above with respect to FIG. 3-1. The disclosed embodiments are not limited in this regard.

Based on FIGS. 2, 3-1, and 3-2 it will be understood that the term rotary steerable tool may be descriptive of (and therefore include) a tool that is separable from the drill bit (e.g., as in rotary steerable tools 50 and 50' depicted in FIGS. 2 and 3-1) or a steerable drill bit (e.g., as in steerable bit 70 depicted in FIG. 3-2). The disclosed embodiments are not limited in this regard.

Figures 1, 4:
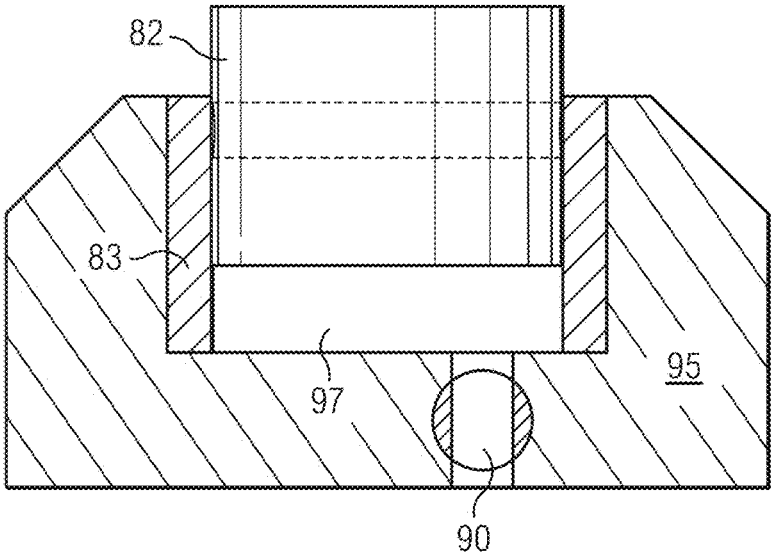
Figures 2, 4:
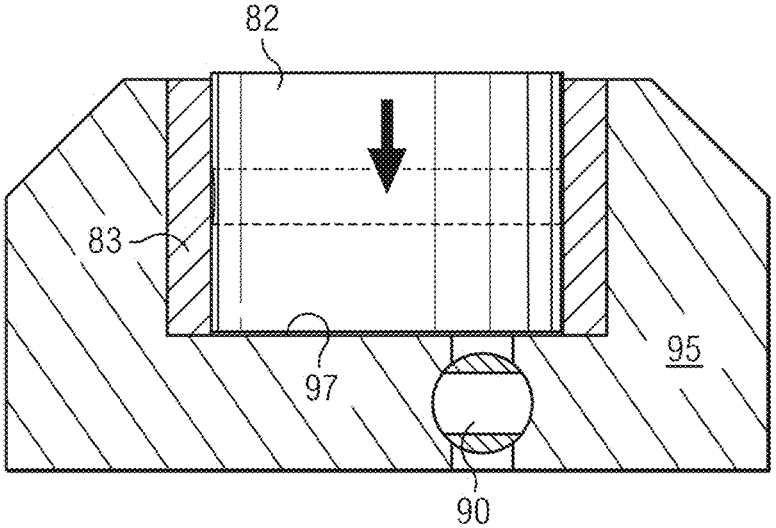

FIGS. 4-1 and 4-2 (collectively FIG. 4) depict cross sectional views of one of the pads 60 shown in extended (FIG. 4-1) and retracted (FIG. 4-2) positions. In the example embodiment shown, a piston 82 is deployed in a corresponding sleeve 83 in pad housing 95. As noted above, the piston 82 is configured to extend outward (as shown on FIG. 4-1) from the housing 95, for example, when valve 90 is open thereby porting drilling fluid through the valve 90 to cavity 97 (which is located radially behind the piston 82 in FIG. 4). The piston 82 may be further configured to retract when valve 90 is closed and drilling fluid is diverted away from the cavity 97 (e.g., via providing a leak path or active exhaust of the fluid in cavity 97 and/or via spring bias). It will be understood that the disclosed method embodiments are not limited to any particular pad 60 or valve 90 configuration with the exception that the pads (and therefore the valves) are independently controllable. For example, in a tool including three circumferentially spaced pads, each of the pads is independently controllable via independent opening and closing of at least one corresponding valve. The valves may include "digital" valves such as two-position (open and closed) solenoid valves. Commonly assigned U.S. Pat. Nos. 8,672,056, 8,919,459, 9,309,722, 9,394,745, 10,439,474, 10,605,005, 11,118,408 and U.S. Patent Publication Nos. 2020/0199942 are incorporated herein by this reference in its entirety and discloses various tool and valve embodiments that may be suitable for use with the method embodiments disclosed herein.

As noted above, the direction of drilling may be controlled by actuating the pads 60 (in tools 50, 50', and 70) with pressurized drilling fluid. The use of rotary valves in such pad actuation is well known. During an active steering mode the pads extend and retract in a predetermined range of toolface angles to cause the drill bit to drill in a predetermined direction. For example, when building (increasing) inclination, each pad may be extended at the low side of the wellbore and retracted at the opposing high side of the wellbore such that the drill bit turns upward (builds inclination). During a neutral mode (or phase) the toolface angle at which the pads extend and retract changes with time as the tool rotates such that drilling tends to proceed straight ahead. In common drilling operations, the active and neutral modes are alternated over short duration cycles (e.g., a few minutes) to define a steering ratio (the ratio of the time in active mode to the cycle time). Wellbore curvature may be controlled by selecting the steering ratio.

The aforementioned pads 60 may also be independently actuated using digital valves (e.g., solenoid valves). During the active steering mode the pads extend and retract at predetermined toolface angles (or are extended over a predetermined range of toolface angles) in a manner similar to that described above for rotary valve embodiments. During the neutral mode, the digital valves remain closed such that the pads are retracted and drilling tends to proceed straight ahead. While these rotary valve and digital valve control methodologies are generally serviceable, there is room for improvement and optimization, for example, to improve steering efficiency and to reduce pad wear.

In the above described prior art methods, the active and neutral drilling modes are alternated without any consideration that certain times may be more or less well suited for active steering than other times. For example, to achieve a steering ratio of 30 percent, the active mode and neutral mode are alternated with the active mode being utilized 30 percent of the total time (e.g., alternating a 1 minute active mode and a 2 min 20 sec neutral mode).

One aspect of the disclosed embodiments was the realization that actuating (extending) the pads at certain times may provide more efficient steering than actuation at other times. In other words it was realized that there may be certain preferred times for extending and/or retracting the pads in a drilling operation and that steering efficiency may be improved by selecting such preferred times for pad actuation.

Figure 5:
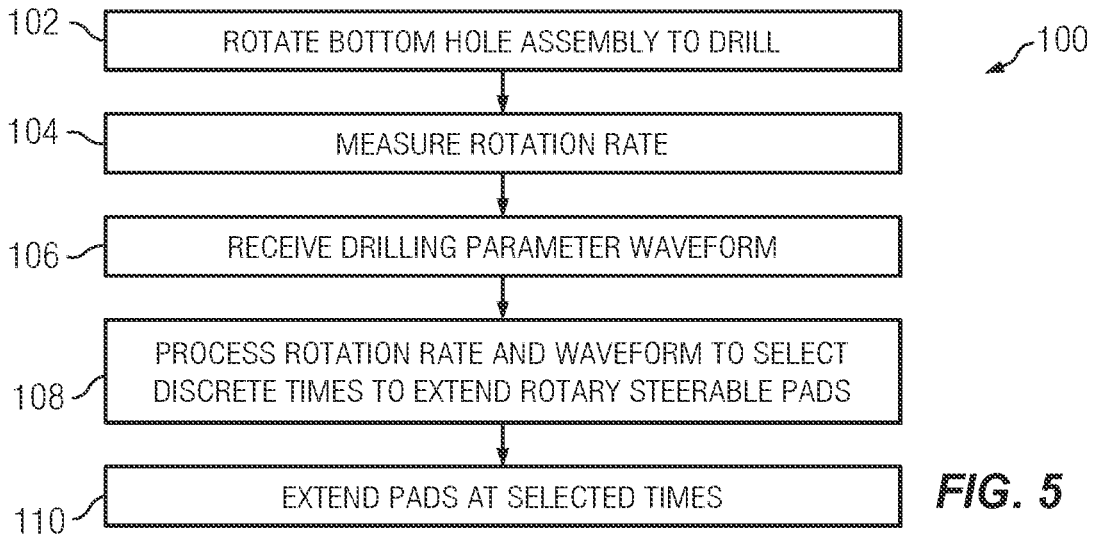
FIG. 5 depicts a flow chart of one example method embodiment for drilling a subterranean wellbore.

FIG. 5 depicts a flow chart of one example method embodiment 100 for drilling a subterranean wellbore. The method includes rotating a bottom hole assembly (BHA) in the subterranean wellbore at 102 to drill the well. The BHA includes at least a drill bit and a rotary steerable tool, for example, including one of the rotary steerable tools 50, 50' or steerable bits 70 described above with respect to FIGS. 1-4. It will be understood that the BHA may be rotated at 102 from the surface (e.g., using a top drive), from a downhole position in the drill string above the steering tool 50, 50' (e.g., using a mud motor), or from both the surface and the downhole position (e.g., as in a power drilling operation). The disclosed embodiments are not limited in this regard.

With continued reference to FIG. 5, the rotation rate of the BHA (or drill string) may be measured at 104. The rotation rate may be measured (or computed), for example, using triaxial accelerometer and/or triaxial magnetometer measurements (e.g., via differentiating sequential magnetic or gravity toolface measurements) or via gyroscopic angular velocity measurements. The measurements in 104 may further include toolface measurements. Those of ordinary skill will readily appreciate that gyroscopic and magnetometer measurements can provide more precise toolface and rotation rate measurements as compared to accelerometer measurements alone.

A waveform is received at 106. The waveform may be representative of substantially any periodic or cyclic drilling parameter that may influence drilling and/or steering. For example, the waveform may be representative of a periodically varying drilling fluid pressure in the steering tool 50, 50' or steerable bit 70. In such an embodiment, the waveform may be obtained, for example, via downhole drilling fluid pressure measurements, drilling fluid flow rate measurements, turbine voltage, current, or rpm measurements, and/or from a measurement while drilling (MWD) telemetry controller. The waveform may be indicative, for example, of the carrier signal utilized in a MWD mud siren (continuous wave) telemetry operation and may have a frequency, for example, in a range from about 1 to about 20 Hz (although the disclosed embodiments are not limited in this regard). The waveform may also be indicative of instability in the surface pumps that pump drilling fluid into the wellbore.

The rotation rate measured at 104 and the waveform received at 106 may be processed in combination at 108 to select discrete times at which to extend and/or retract rotary steerable pads and thereby actuate steering. The pads may be independently extended and retracted, for example, by opening and closing corresponding digital valves in the tool as described above. Opening such a digital valve connects the rotary steerable pad with pressurized drilling fluid in the steering tool and thereby rapidly extends the pad (e.g., into contact with the wellbore wall). Closing the valve disconnects the pad from the pressurized drilling fluid and enables the pad to be retracted (e.g., via contact with the wellbore wall and venting of the fluid into the annulus). The pads may then be extended and/or retracted at 110 at the discrete times selected in 108.

For example, in an embodiment in which the waveform is indicative of drilling fluid pressure versus time, the pads may be extended at the predetermined toolface angle only when the drilling fluid pressure exceeds a predetermined threshold. The predetermined threshold may be computed, for example, from the steering ratio and the waveform.

In an alternative embodiment in which the waveform is indicative of drilling fluid pressure versus time, the total extension time (or the toolface angle range) over which the pad is extended per actuation cycle (a single extension and retraction) may be varied. For example, the total extension time (toolface angle range) may be controlled so that it is inversely related to the drilling fluid pressure in the waveform. As pressure increases (thereby increasing the force in the pad) the total extension time (the valve closing time minus the valve opening time) may be decreased so as to maintain a constant impulse (force times time) on the wellbore wall. In such an embodiment, the total extension time may be reduced when the pad opening overlaps a waveform maximum and increased when the pad opening overlaps a waveform minimum.

Figure 6:
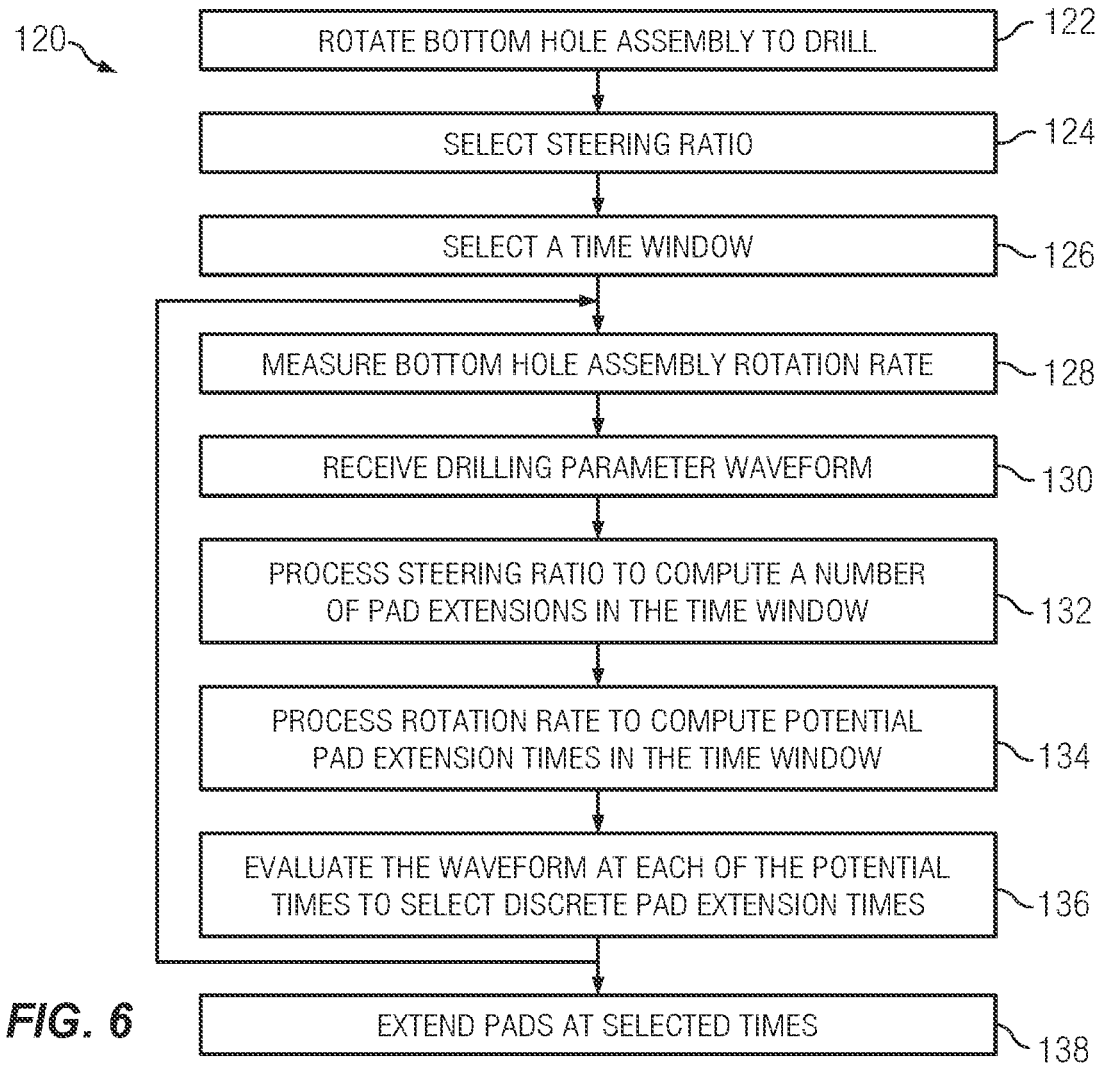
FIG. 6 depicts a flow chart of another example method embodiment for drilling a subterranean wellbore.

FIG. 6 depicts a flow chart of another example method embodiment 120 for drilling a subterranean wellbore. The method includes rotating a BHA in the subterranean wellbore at 122 to drill the well (as described above in FIG. 5). A steering ratio is selected at 124 and a forward looking time interval (time window) is selected at 126. The rotation rate of the BHA is measured at 128 and a drilling parameter waveform is received at 130 (as also described above with respect to FIG. 5).

With continued reference to FIG. 6, method 120 is intended to control pad extension times in subsequent (forward looking) time intervals while drilling in 122. As noted above, the time interval may be selected at 126. Substantially any suitable time interval may be selected. Moreover, the time interval may be counted in tool rotations (revolutions) rather than standard time units (seconds or minutes). It will be understood that selecting the time interval defines a total number of potential pad extensions (referred to herein as m). When the time interval includes a predefined number of revolutions r, the total number of potential pad extensions equals 3r (for tool embodiments including three circumferentially spaced pads). When the time interval includes a fixed time, the total number of potential pad extensions may be computed from the rotation rate measured in 128.

Method 120 further includes processing the selected steering ratio at 132 to determine a number n of pad extensions in the time interval. For example, the number n of pad extensions may equal the steering ratio times the total number of potential pad extensions m in the time interval. The BHA rotation rate may be processed at 134 to compute times for each of the potential pad extensions and/or retractions in the time interval (such that the pads open and close at approximately preselected toolface angles). These times may be computed, for example, from the rotation rate and the desired toolface angle for pad extension and/or retraction. The desired toolface angle (or toolface angle range) may also be varied based on the waveform as described above. At 136 the waveform received at 130 is processed at each of the times computed in 134 to select the discrete pad extension times (n total based on the steering ratio). For example, the discrete pad extension times may be selected as those times at which the waveform has maximum values or values above a predetermined threshold. The pads may then be extended at 138 at the discrete times selected in 136. It will be understood that method steps 128 through 136 may be repeated substantially any number of times (and for substantially any number of time intervals) while drilling in 122.

Figure 7:
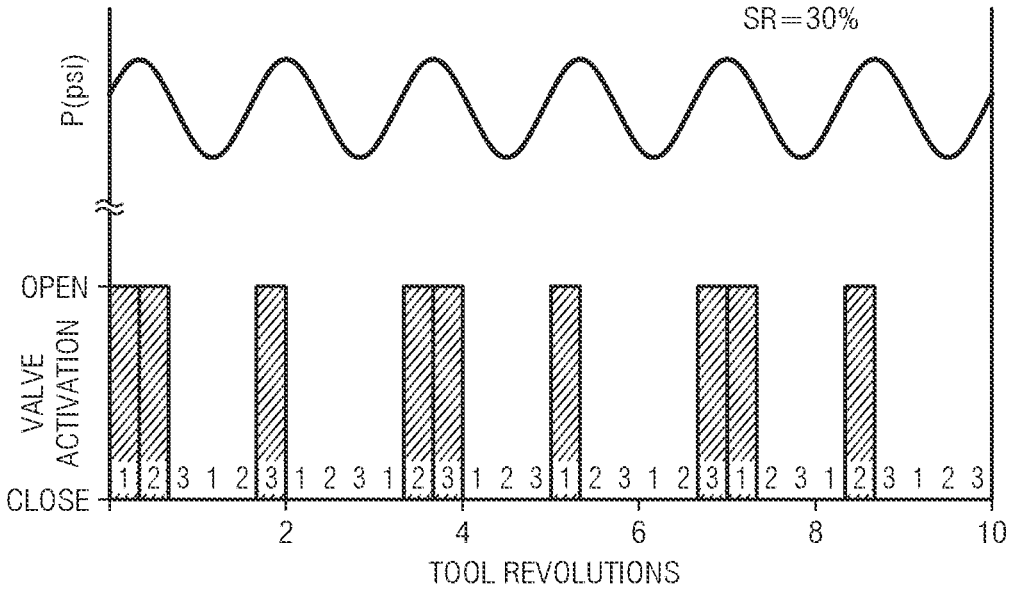
FIG. 7 depicts an example implementation of a disclosed method for drilling a subterranean wellbore in graphical form.

FIG. 7 depicts an example implementation in graphical form. The waveform received in 130 is depicted in the upper portion of the plot and in this embodiment depicts drilling fluid pressure in units of psi versus time in units of tool revolutions. The total potential number of pad extensions in the selected time interval is shown along the horizontal axis. These potential pad extensions are labelled as '1', '2', or '3' indicating which of the three circumferentially spaced pads is rotating through the preselected toolface window. In this example embodiment, the selected time interval is 10 tool revolutions (i.e., the time it takes for the tool to rotate through 10 revolutions). The total potential number of pad extensions is therefore 30 (3 circumferentially spaced pads times 10 revolutions).

With continued reference to FIG. 7, the selected steering ratio (selected at 124) is 30 percent. The number of required pad extensions in the selected time interval is computed at 132 of FIG. 6 and is 9 in this example (30 percent times 30 potential extensions). In the depicted example, the discrete times of these nine required pad extensions (determined in 136) are selected from the times of the 30 potential total pad extensions, for example, to maximize the average drilling fluid pressure during the pad extensions (such that the pads exert a maximum average force on the wellbore wall when extended). In the depicted example, six of the nine pad extensions overlap with waveform maxima. The other three pad extensions are selected to overlap with a shoulder region adjacent to the maxima.

With continued reference to FIGS. 6 and 7, it will be appreciated that selection of the discrete times in 136 may optionally be constrained so that each pad (of the three circumferentially spaced pads in this example embodiment) is extended an approximately equal number of times (e.g., such that no one pad is opened more than twice that of another pad). Such control may advantageously promote uniform pad wear. In the embodiment depicted on FIG. 7, each pad is actuated three times over 10 revolutions to achieve nine total pad extensions and the 30 percent steering ratio. The disclosed embodiments are of course not limited in this regard.

Figure 8:
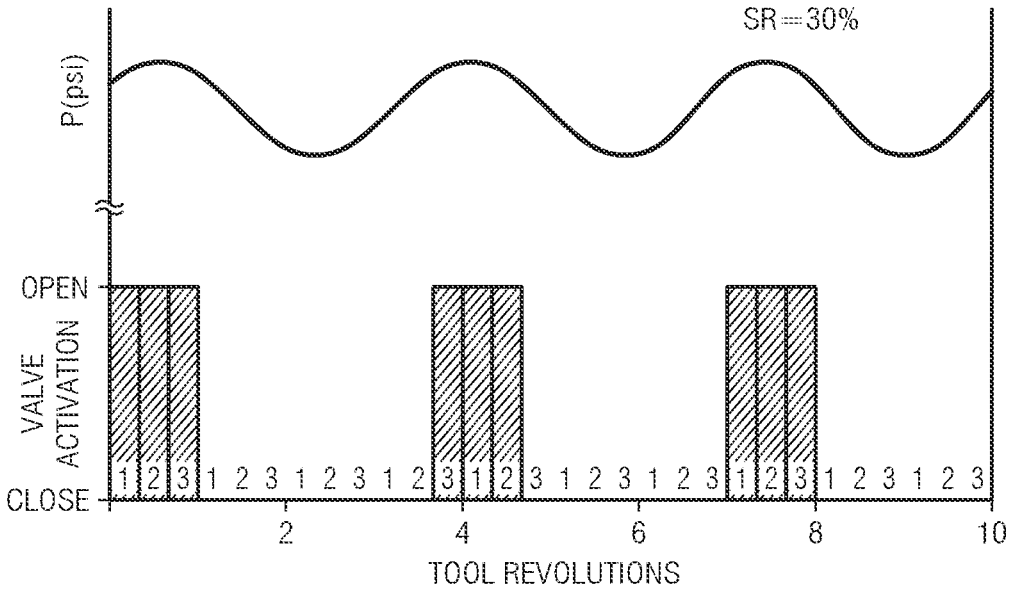
FIG. 8 depicts another example implementation of a disclosed method for drilling a subterranean wellbore in graphical form.

FIG. 8 depicts another example implementation in graphical form. As in FIG. 7, the received waveform is depicted in the upper portion of the plot and the selected time interval is 10total revolutions (for 30 total potential number of pad extensions). In this example, the discrete times selected in 136 are constrained to require three consecutive pad extensions, thereby ensuring a similar number of extensions for each pad. In a similar embodiment, although not depicted on FIG. 8, the constraint may restrict the times selected in 136 to individual revolutions such that either (i) each of the pads extends in particular revolution or (ii) none of the pads are extended (where the revolutions can be defined as beginning with any one of the pads). As depicted in FIG. 8, the consecutive pad extensions are selected to overlap with certain maxima in the waveform and thereby maximize the average drilling fluid pressure during the pad extensions (within the bounds of the constraint).

In the FIG. 8 example, the frequency of the waveform is about 3/10 that of the rotational frequency. As depicted in this embodiment, there is ample time for at least three pad extensions in each waveform maximum. Embodiments that are constrained to require three consecutive pad extensions may therefore be most suitable when the frequency of the waveform is one third or less than that of that rotational frequency.

It will be appreciated that the disclosed embodiments may further include feedback steps in which pad extension/retraction and/or valve actuation in prior time intervals is evaluated. For example, the waveform may be continuously measured while drilling (e.g., via downhole pressure or flow measurements). The measured waveform and the valve actuation times from the prior time interval(s) may be compared to determine how closely the valves were opened and/or closed to the desired region of the waveform. An error term may be defined to quantify the deviation of the actual valve opening and/or closing times from the desired times. This error term may then be used at 108 of method 100 (FIGS. 5) and 134 and 136 of method 120 (FIG. 6) in the selection of the discrete pad extension times.

Figure 9:
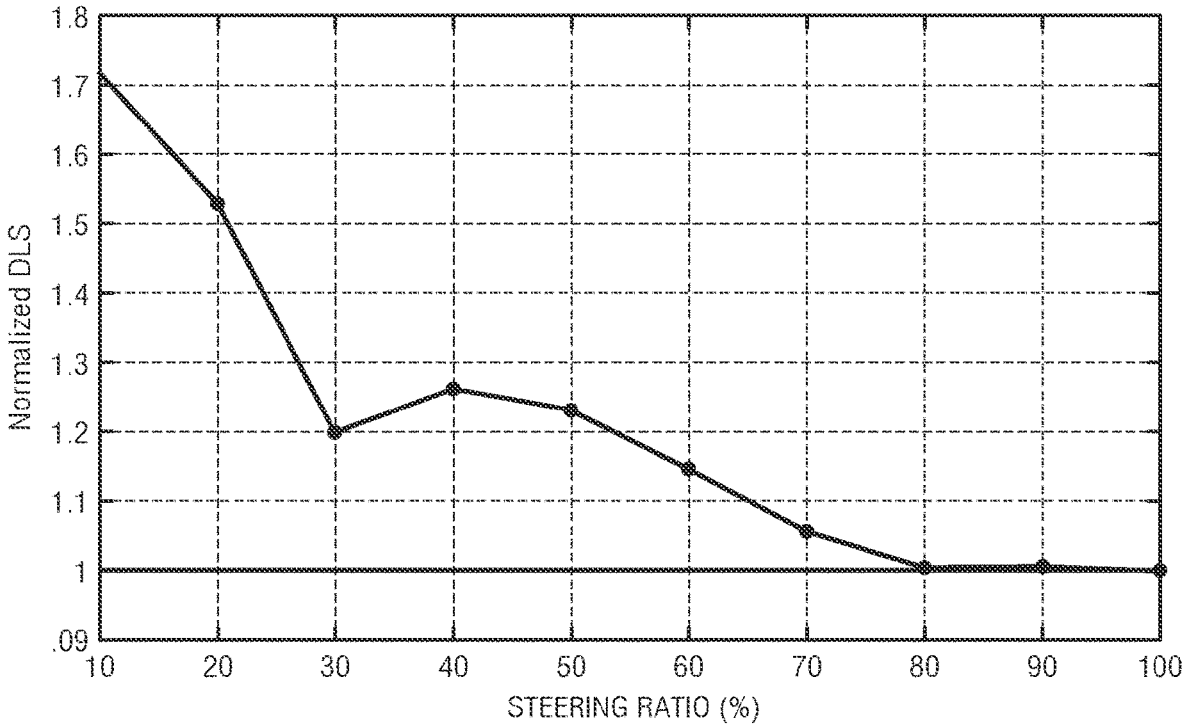
FIG. 9 depicts a plot of normalized dogleg severity versus steering ratio for one example implementation.

The disclosed embodiments may provide various technical advantages. For example, by selecting discrete pad actuation times that overlap with the waveform maxima the steering force applied by the pads may be increased which may in turn improve the steering efficiency. FIG. 9 depicts a plot of normalized dogleg severity versus steering ratio. The normalized dogleg severity is the dogleg severity achieved using method 100 or 120 divided by a dogleg severity achieved using a conventional rotary valve methodology. In this example, the tool rotation rate was 300 rpm (5 Hz), the waveform frequency was 1 Hz, and the flow amplitude of the waveform was about 13 percent of the DC bias flow amplitude.

As depicted on FIG. 9, the disclosed example provides a significant dogleg severity improvement (steering efficiency improvement). At steering ratios of less than 20 percent, the disclosed example provides at least a 50 percent increase in dogleg severity. At steering ratios less than 50 percent, the disclosed methodology provides at least a 20 percent increase in dogleg severity. Stated another way the disclosed methods may require fewer pad openings and therefore a lower steering ratio to achieve a comparable dogleg severity. The disclosed embodiments may therefore provide for reduced pad wear and improved tool life and reliability.

With further reference to FIGS. 7 and 8, it will be understood that the disclosed embodiments are not limited to extending the pads at waveform maxima. In alternative embodiments it may be advantageous to extend the pads (and therefore open the valves) at waveform minima to reduce the steering force applied by the pads. Reducing the steering force may provide improved control in low dogleg wellbore sections, for example, by requiring an increased steering ratio. It will be understood that increasing the steering ratio increases the contact time between the pads and the wellbore wall and may therefore provide increased stabilization to the BHA. Again, the disclosed embodiments are not limited in these regards.

It will be appreciated that the disclosed methods may be configured for implementation via one or more controllers deployed downhole (e.g., in a rotary steerable tool such as one of the rotary steerable tools 50 described above with respect to FIGS. 1-4). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 5 and 6. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

It will be understood that this disclosure may include numerous embodiments. These embodiments include, but are not limited to, the following embodiments.

A first embodiment may comprise a method for drilling a subterranean wellbore. The method includes (a) rotating a bottom hole assembly (BHA) in the subterranean wellbore to drill, the BHA including a rotary steerable tool or a steerable drill bit having at least one external pad configured to extend radially outward into contact with a wall of the wellbore and thereby steer the drilling; (b) measuring a rotation rate of said BHA rotation in (a); (c) receiving a drilling parameter waveform; (d) processing the BHA rotation rate measured in (b) and the drilling parameter waveform received in (c) to select discrete times for extending the at least one external pad while rotating in (a); and (e) extending the at least one external pad at said discrete times.

A second embodiment may include the first embodiment, wherein (a) further comprises selecting a steering ratio and selecting a time interval for computing said discrete times in (d).

A third embodiment may include the second embodiment, wherein (d) further comprises processing the steering ratio selected in (a) to compute a number of pad extensions in said selected time interval.

A fourth embodiment may include the second or third embodiment wherein (d) further comprises computing a total number of potential pad extensions in said selected time interval.

A fifth embodiment may include the fourth embodiment, wherein (d) further comprises processing the rotation rate and the total number of potential pad extensions in said selected time interval to compute times for each of the potential pad extensions in said selected time interval.

A sixth embodiment may include the fifth embodiment, wherein (d) further comprises evaluating the waveform received in (c) at each of the computed times of the potential pad extensions in said selected time interval to select the discrete pad extension times.

A seventh embodiment may include the sixth embodiment, wherein the discrete pad extension times are selected to overlap maxima in the waveform.

An eighth embodiment may include the sixth or seventh embodiment wherein: the rotary steerable tool or a steerable drill bit includes at least first, second, and third circumferentially spaced external pads; and (d) further comprises constraining said selection of the discrete pad extension times so that no one of the first, second, and third pads is extended more than twice that of another of said first, second, and third pads.

A ninth embodiment may include any one of the sixth through eighth embodiments wherein: the rotary steerable tool or a steerable drill bit includes at least first, second, and third circumferentially spaced external pads; and (d) further comprises constraining said selection of the discrete pad extension times to require three consecutive pad extensions.

A tenth embodiment may include any one of the first through ninth embodiments, wherein the waveform is representative of drilling fluid pressure in the rotary steerable tool or steerable bit.

An eleventh embodiment may include any one of the first through tenth embodiments, wherein (d) further comprises processing the BHA rotation rate measured in (b) and the drilling parameter waveform received in (c) to select a total extension time per pad actuation cycle.

A twelfth embodiment may comprise a method for drilling a subterranean wellbore. The method may include: (a) rotating a bottom hole assembly (BHA) in the subterranean wellbore to drill, the BHA including a rotary steerable tool or a steerable drill bit having at least first, second, and third circumferentially spaced external pads configured to extend radially outward into contact with a wall of the wellbore and thereby steer the drilling; (b) selecting a steering ratio; (c) selecting a time interval; (d) measuring a rotation rate of said BHA rotation in (a); (e) receiving a drilling parameter waveform; (f) processing the steering ratio selected in (a) to compute a number of pad extensions in the time interval selected in (c); (g) processing the rotation rate measured in (d) and a total number of potential pad extensions in the said selected time interval to compute times for each of the potential pad extensions in said selected time interval; (h) evaluating the waveform received in (c) at each of the computed times of the potential pad extensions in said selected time interval to select discrete pad extension times; and (i) extending the first, second, and third pads at corresponding ones of said selected discrete pad extension times.

A thirteenth embodiment may include the twelfth embodiment, wherein the discrete pad extension times are selected to overlap maxima in the waveform.

A fourteenth embodiment may include the twelfth or thirteenth embodiment, wherein: (h) further comprises constraining said selection of the discrete pad extension times so that no one of the first, second, and third pads is extended more than twice that of another of said first, second, and third pads.

A fifteenth embodiment may include the twelfth or thirteenth embodiment, wherein: (h) further comprises constraining said selection of the discrete pad extension times to require three consecutive pad extensions.

A sixteenth embodiment may include any one of the twelfth through fifteenth embodiments, wherein: the waveform is representative of drilling fluid pressure in the rotary steerable tool or steerable bit.

A seventeenth embodiment may include the sixteenth embodiment, wherein the waveform is received from downhole drilling fluid pressure measurements, downhole drilling fluid flow rate measurements, turbine voltage, current, or rpm measurements, or from a measurement while drilling telemetry controller.

Although a method for drilling a subterranean wellbore has been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers'specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for drilling a subterranean wellbore, the method comprising:

(a) rotating a bottom hole assembly (BHA) in the subterranean wellbore to drill, the BHA including a rotary steerable tool or a steerable drill bit having at least first, second, and third circumferentially spaced external pads configured to extend radially outward into contact with a wall of the wellbore and thereby steer the drilling;

(b) measuring, via a sensor, a rotation rate of the BHA rotation in (a);

(c) receiving, via a processor, a drilling parameter waveform; wherein the drilling parameter waveform is sinusoidal in shape;

(d) processing, via the processor, the BHA rotation rate measured in (b) and the drilling parameter waveform received in (c) to select discrete times for extending the at least first, second, and third external pads while rotating in (a), wherein the discrete times are selected to overlap maxima in the drilling parameter waveform; and (e) extending the at least first, second, and third external pads at the discrete times to steer the drilling.

2. The method of claim 1, wherein (a) further comprises selecting a steering ratio and selecting a time interval for computing the discrete times in (d).

3. The method of claim 2, wherein (d) further comprises processing the steering ratio selected in (a) to compute a number of pad extensions in the selected time interval.

4. The method of claim 2, wherein (d) further comprises computing a total number of potential pad extensions in the selected time interval.

5. The method of claim 4, wherein (d) further comprises processing the rotation rate and the total number of potential pad extensions in the selected time interval to compute times for each of the potential pad extensions in the selected time interval.

6. The method of claim 5, wherein (d) further comprises evaluating the drilling parameter waveform received in (c) at each of the computed times of the potential pad extensions in the selected time interval to select the discrete times.

7. The method of claim 6, wherein:

(d) further comprises constraining the selection of the discrete times so that no one of the at least first, second, and third pads is extended more than twice that of another of the at least first, second, and third pads.

8. The method of claim 6, wherein:

(d) further comprises constraining the selection of the discrete times to require three consecutive pad extensions.

9. The method of claim 1, wherein the drilling parameter waveform is representative of drilling fluid pressure in the rotary steerable tool or the steerable bit.

10. The method of claim 1, wherein (d) further comprises processing the BHA rotation rate measured in (b) and the drilling parameter waveform received in (c) to select a total extension time per pad actuation cycle.

11. A method for drilling a subterranean wellbore, the method comprising:

(a) rotating a bottom hole assembly (BHA) in the subterranean wellbore to drill, the BHA including a rotary steerable tool or a steerable drill bit having at least first, second, and third circumferentially spaced external pads configured to extend radially outward into contact with a wall of the wellbore and thereby steer the drilling;

(b) selecting, via a processor, a steering ratio;

(c) selecting, via the processor, a time interval;

(d) measuring, via a sensor, a rotation rate of the BHA rotation in (a);

(e) receiving, via the processor, a drilling parameter waveform; wherein the drilling parameter waveform is sinusoidal in shape;

(f) processing, via the processor, the steering ratio selected in (b) to compute a number of pad extensions in the time interval selected in (c);

(g) processing, via the processor, the rotation rate measured in (d) and a total number of potential pad extensions in the selected time interval to compute times for each of the potential pad extensions in the selected time interval;

(h) evaluating, via the processor, the drilling parameter waveform received in (e) at each of the computed times of the potential pad extensions in the selected time interval to select discrete pad extension times, wherein the discrete pad extension times are selected to overlap maxima in the drilling parameter waveform; and (i) extending the at least first, second, and third pads at corresponding ones of the selected discrete pad extension times to steer the drilling.

12. The method of claim 11, wherein:

(h) further comprises constraining the selection of the discrete pad extension times so that no one of the at least first, second, and third pads is extended more than twice that of another of the at least first, second, and third pads.

13. The method of claim 12, wherein:

(h) further comprises constraining the selection of the discrete pad extension times to require three consecutive pad extensions.

14. The method of claim 11, wherein the drilling parameter waveform is representative of drilling fluid pressure in the rotary steerable tool or the steerable bit.

15. The method of claim 14, wherein the drilling parameter waveform is received from at least one of downhole drilling fluid pressure measurements, downhole drilling fluid flow rate measurements, turbine voltage, current, rpm measurements, or a measurement while drilling telemetry controller.

* * * * *